US005188298A

United States Patent [19]

Gerber

[11] Patent Number: 5,188,298

[45] Date of Patent: Feb. 23, 1993

[54] METHOD AND APPARATUS FOR FIBERIZING

[75] Inventor: Milton Gerber, Ossian, Ind.

[73] Assignee: Advanced Fiber Technology, Inc., Bucyrus, Ohio

[21] Appl. No.: 785,029

[22] Filed: Oct. 30, 1991

[51] Int. Cl.[5] ..... B02C 23/08

[52] U.S. Cl. ..... 241/5; 241/19; 241/24; 241/51; 241/81; 241/86.1

[58] Field of Search ..... 241/5, 19, 24, 48, 51, 241/74, 86.1, 81

[56] References Cited

U.S. PATENT DOCUMENTS

| | | | |
|---|---|---|---|
| 1,758,702 | 5/1930 | Jacobson | 241/51 |
| 1,934,180 | 11/1933 | Fischer et al. | 241/51 |
| 2,474,314 | 6/1949 | Koehne | 241/51 |
| 2,517,990 | 8/1950 | Dressel | 241/86.1 |
| 3,055,597 | 9/1962 | Mund | 241/81 |
| 4,919,340 | 4/1990 | Gerber | 241/5 |
| 5,085,376 | 2/1992 | Lichtenburg | 241/56 |
| 5,092,527 | 3/1992 | Perry et al. | 241/19 |

*Primary Examiner*—Mark Rosenbaum
*Assistant Examiner*—John M. Husar
*Attorney, Agent, or Firm*—Harness, Dickey & Pierce

[57] ABSTRACT

A method and apparatus for communicating feed stock in the form of shreds or the like to form a low density particulate product. The shredded feed stock is fed to a material handling rotor that functions as a centrifugal blower. The apparatus includes a housing that defines a cylindrical rotor chamber formed about a horizontal axis and a volute-shaped internal passage having at least one convolution formed around the rotor chamber. Located within the housing is a cylindrical screen with perforations that open into the rotor chamber. The centrifugal blower rotor is mounted in the rotor chamber and has a plurality of radial vanes with rakers attached to the outer ends closely spaced from the inner surface of the screen so that they continuously wipe pass the perforations to prevent clogging or blinding.

26 Claims, 6 Drawing Sheets

METHOD AND APPARATUS FOR FIBERIZING

BACKGROUND OF THE INVENTION

This invention relates to the production of communiuted products such as fibrous thermal insulation and especially to an improved method and apparatus for producing such products. More particularly, the invention relates to a novel method and apparatus that utilize the energy generated by producing a high velocity flow of air with feed stock entrained therein, combined with mechanical action to comminute the material with minimal damage to the resulting product. This invention relates to and is an improvement on my invention described in my U.S. Pat. No. 4,919,340, and that patent is incorporated by reference herein.

Typically, dry-process comminuting of both organic and inorganic material for use as thermal insulation, absorbent pads, filters, and the like, is achieved by using conventional hammer mills. It has been found, however, that the use of hammer mills cannot produce a comminuted mass optimum physical properties of low mass density, high thermal resistance to heat flow, high moisture absorbance, acceptable aesthetic appearance and other desirable characteristics.

Hammer mill designs utilize hammers or beaters that are pivotally mounted on a series of disks that rotate within a partial cylindrical sizing screen. The feed stock is typically fed into the mill via an air stream flowing perpendicular to the rotating hammers. The entire mass of feed stock is then drawn into a wedge-shaped space and onto the beginning of the sizing screen comprising a major pinch point and then forced through and over a typical semi-cylindrical screen.

Due to the extraordinary pressure exerted on the screen at the entry pinch point, heavy gauge 3/16 to ¼ inch thick perforated metal screens are needed to prevent breakage from fatigue the heavy gauge further limits the perforated open area to 30 to 40% and restricts the possible use of smaller perforations.

As a result of the input feed method, the swing hammers will retract as the feed stock is worked through the screen, thereby reducing the air flow due to a relatively thick mat of material, blinding the screen and increasing the feed residence time within the machine, resulting in fines and dust. This deficiency is often mitigated by using screens with larger perforations. This results in large, uncomminuted pieces remaining in the product.

Another deficiency is that the hammers are supported between disks, which in turn prevent complete utilization of the comminuting screen surfaces, adding to the blinding of the perforations. As most of the systems are set up to be air swept, blinding of perforations can have a major negative effect by retarding air flow and increasing energy consumption and product degradation.

The method and apparatus of the present invention, however, resolve many of the problems listed above and provide other features and advantages heretofore not obtainable.

SUMMARY OF THE INVENTION

It is among the objects of the present invention to provide a dry-process comminution method and apparatus for producing a mass containing a greatly improved and uniform particle size distribution from organic and/or inorganic pieces, shreds or fragments of isotropic feed stocks.

Another object is to produce a communiuted mass to be used for thermal insulation, absorbent pads, filter media, and other commercial and industrial use.

A further object is to provide a machine that is substantially more energy efficient per unit of product output over prior art devices.

A further object is to provide an apparatus with a positive and consistents comminuting action without blinding the internal sizing screens.

These and other objects and advantages of the invention are achieved with the unique method and apparatus of the invention whereby feed stock, (which may be shredded, for example) entrained in air stream flowing in a duct, is fed to a material-handling rotor that greatly increases the velocity of the flowing stream of air and utilizes the energy thus produced together with mechanical action to: (1) separate the feed stock as much as possible into individual particles or fibers, (2) centrifugally separate the comminuted product from a large part of the flowing air stream, and then (3) deliver the resulting product for further processing.

In accordance with the apparatus of the invention, a housing is provided with walls that define a cylindrical rotor chamber formed about a horizontal axis. The housing also defines a volute-shaped internal passage having at least one convolution formed around the rotor chamber and centered about the axis, a tangential outlet from the volute-shaped passage, and an axial inlet to admit a mixture of feed stock and air to the central portion of the centrifugal blower chamber.

An air re-circulation duct assembly is connected between a radially inward portion of the tangential outlet and the axial inlet for recycling separated air from the outlet to the rotor chamber. Also, a feed stock supply duct is provided for delivering material to the axial inlet. In accordance with the invention, a diverter means is provided for directing a flow of entering material through a trap means to provide for metal separation.

Mounted within the housing is a cylindrical screen with perforations that communicate between the rotor chamber and volute-shaped passage. A centrifugal blower rotor is mounted in the rotor chamber for rotation about the central axis, the rotor having a plurality of radial vanes that define a plurality of radial cells. Rakers attached to the outer surface of the screen so that they continuously wipe past the perforations to prevent clogging or blinding. Also, a wiping blade means is provided in the rotor chamber adjacent certain side edges of the radial vanes to continuously clean material from the side edges and prevent accumulation and clogging.

In accordance with the method of the invention, the feed stock is fed to the central portion of the cylindrical rotor chamber. The centrifugal blower rotor located within the chamber is driven at relatively high speed to generate a high velocity air flow and to force the feed radially outward in the rotor chamber. The rapidly flowing mixture of feed stock and air impacts against the cylindrical screen so that the product is subjected to comminution forces.

Then the resulting mixture of comminuted particles and air is centrifugally separated to form a portion of the flowing air volume, free of the particles. The separated air volume is returned to the rotor chamber inlet and the remaining mixture of air and comminuted product is discharged for further processing.

DESCRIPTION OF THE PREFERRED EMBODIMENT

Referring more particularly to the drawings, there is shown an apparatus for comminuting pre-shredded or otherwise prepared material, such as paper stock, newsprint, etc., to form a comminuted or fibrous product. The apparatus is placed in an overall processing system which provides means for feeding material entrained in a stream of flowing air to the apparatus and which provides a discharge means for removing the resulting comminuted product from the apparatus.

The apparatus includes as its principal components, a rotor housing assembly 10, a cylindrical screen assembly 40, a rotor assembly 50 and a duct assembly 70.

ROTOR HOUSING ASSEMBLY

Figure 1:
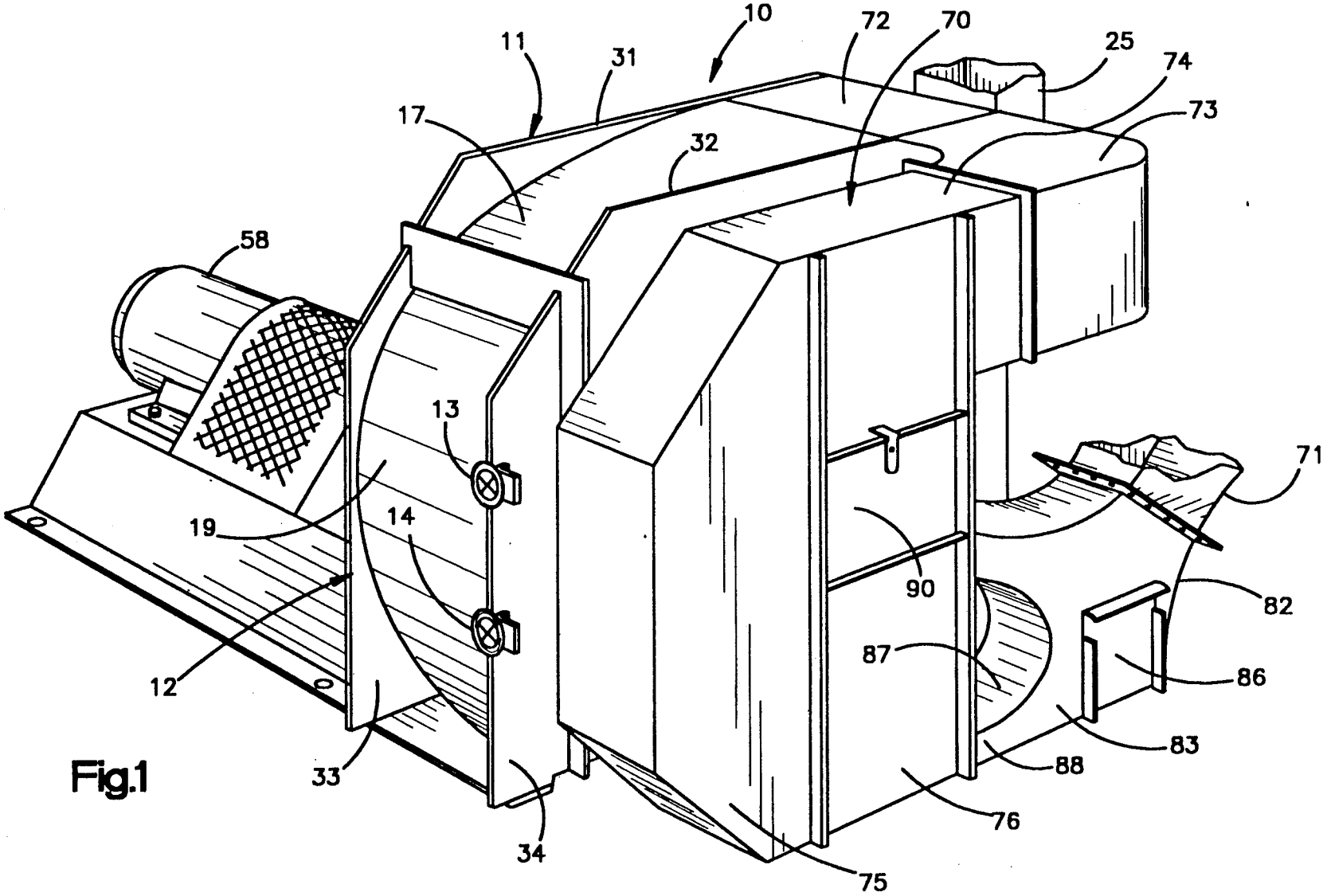
FIG. 1 is a perspective view of a comminuting apparatus embodying the invention.
Figure 2:
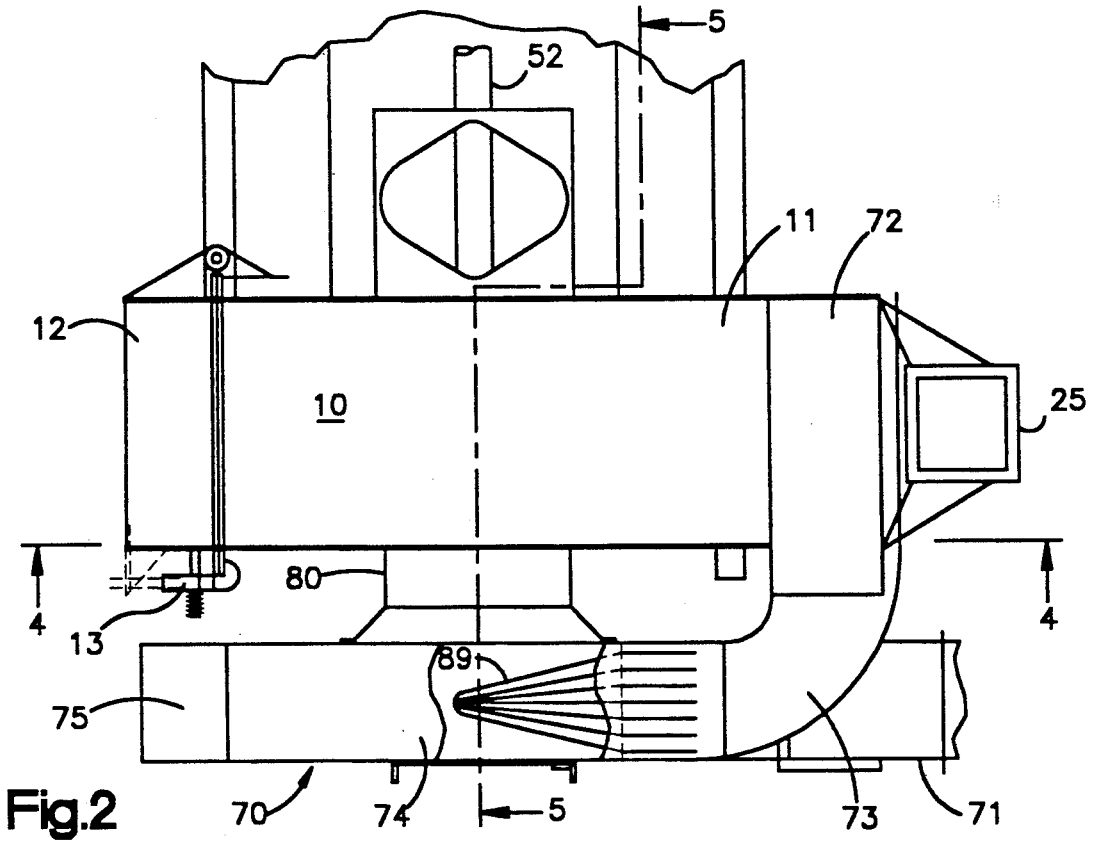
FIG. 2 is a fragmentary plan view of the apparatus of FIG. 1 with parts broken away for the purpose of illustration.
Figure 4:
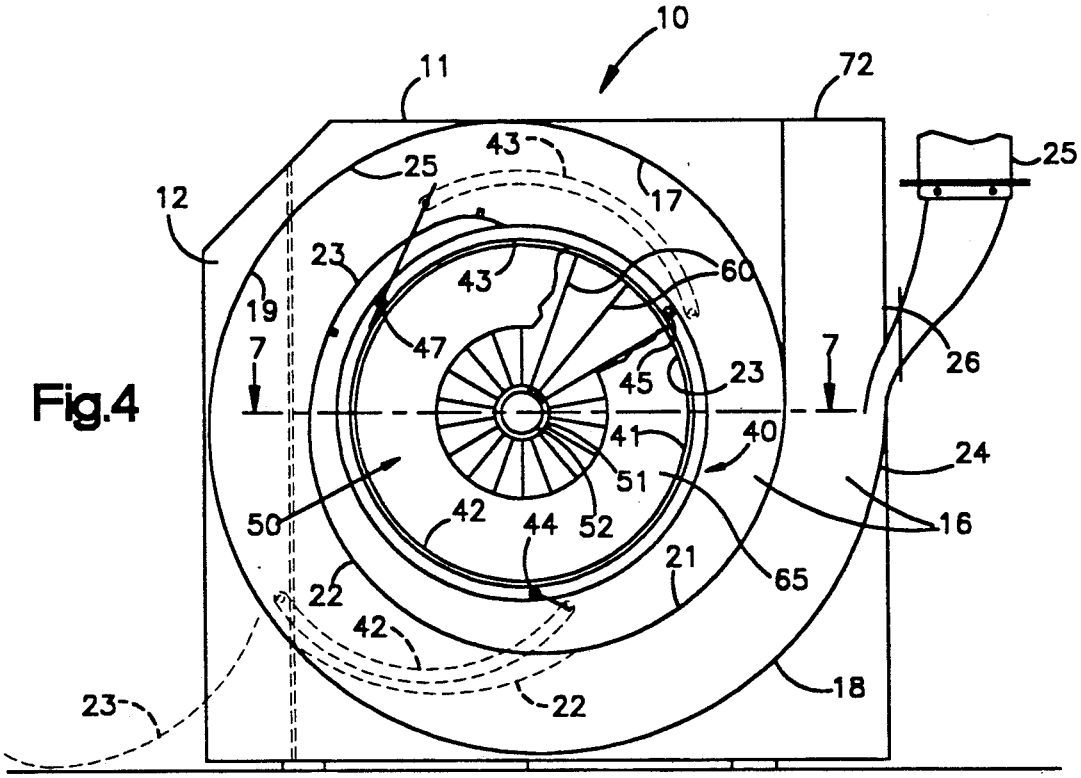
FIG. 4 is a sectional view through the apparatus taken on the line 4—4 of FIG. 2 with parts broken away for the purpose of illustration.

The rotor housing assembly 10 is best illustrated in FIGS. 1, 2 and 4 and comprises as its principal components, a main housing section 11 and an end housing section 12 secured to one another by fastening mechanisms 13 na 14 that permits the end housing section to be removed from the relatively fixed main housing section 11, for assembly, service, replacement of parts, etc. The two housing sections 11 and 12 when assembled, define a central rotor chamber 15 (FIG. 5) in the inner portion and a volute-shaped passage 16 in the outer portion.

The volute-shaped passage 16 surrounds the cylindrical rotor chamber 15 and is otherwise defined by an assembly of curved walls to include outer walls 17, 18 and 19. These are best shown in FIG. 4 wherein it will be seen that the curved wall 17 is located in the upper portion of the main housing section 11, the wall 18 is located in the lower portion of the main housing section and the interconnected wall section 19 is located in the end housing section 12. Accordingly, when the end section 12 is removed, the wall section 19 is also removed to give access to the interior of the volute-shaped passage 16.

Connected to the inner end or right-hand end of the wall section 17 is an assembly of inner wall sections to include a fixed wall section 21 spaced radially inward from the wall 18, and two articulated, movable wall sections 22 and 23. The inner end of the wall section 21 is pivotally connected to the lower end of the inner wall section 22 and its other end is pivotally connected to the movable wall section 23. The opposite end of the movable wall section 23 forms the initial or entry portion of the volute-shaped passage 16. The movable inner wall sections 22 and 23 are shown in their closed, operating position in solid lines in FIG. 4 and in their open or partially removed position in dashed lines in FIG. 4.

The volute-shaped passage 16 thus defined has a tangential outlet 24 at its outer end, as best shown in FIG. 4. At the tangential outlet, the passage separates to a portion directed to a discharge chute 25 at the outer portion and a return portion 26.

The main housing section 11 also has upright, parallel side walls 31 and 32, which help define the sides of the volute-shaped passage and the end housing section 12 also has upright, parallel side walls 33 and 34 that also form side portions of the volute-shaped passage 16.

The side wall 33 has a relatively small central opening 35 formed therein to receive a drive shaft for the rotor assembly 50. The side wall 34 has a relatively large central circular opening 36 formed therein to receive the mixture of feed stock and air.

Also located within the rotor housing assembly 10 is a cylindrical screen assembly 40 that defines, in part, the rotor chamber 15. The cylindrical screen assembly 40 comprises three interconnected circumferential screen sections, each forming about 120° of arc. These sections include a fixed screen section 41 and two movable screen sections 42 and 43 (FIG. 4). One end of the screen section 42 is pivotally connected to an end of the fixed screen section 41 and is opposite end is connected to one end of the movable screen section 43. The connection are located at hinges 44 and 45. This permits the movable sections 42 and 43 to be pivoted to open positions shown in dashed lines in FIG. 4.

Figure 7:
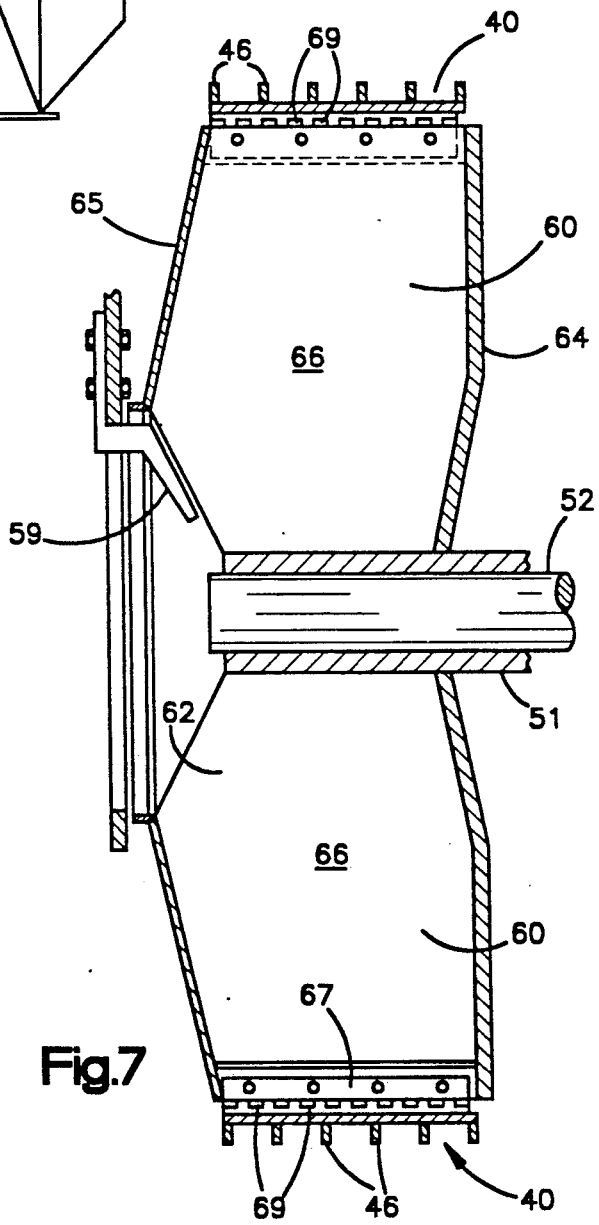
FIG. 7 is a sectional view on an enlarged scale taken on the line 7—7 of FIG. 2.
Figure 8:
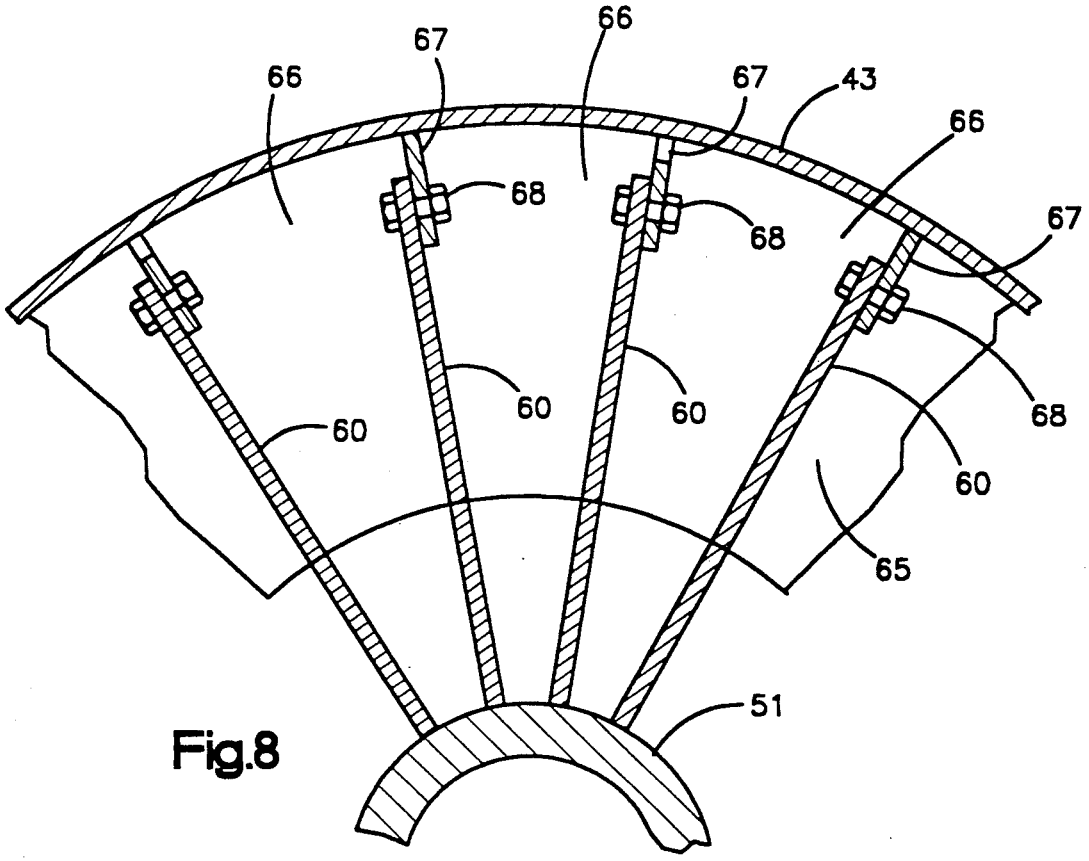
FIG. 8 is a fragmentary sectional view taken on the line 8—8 of FIG. 2.
Figure 9:
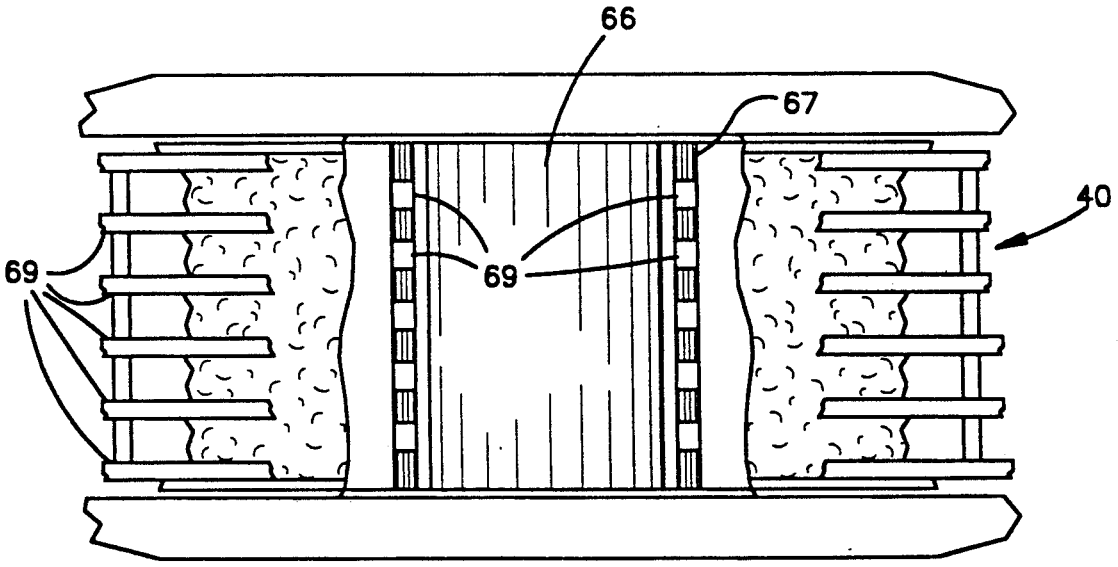
FIG. 9 is a fragmentary sectional view on an enlarged scale taken on the line 9—9 of FIG. 4.
Figure 10:
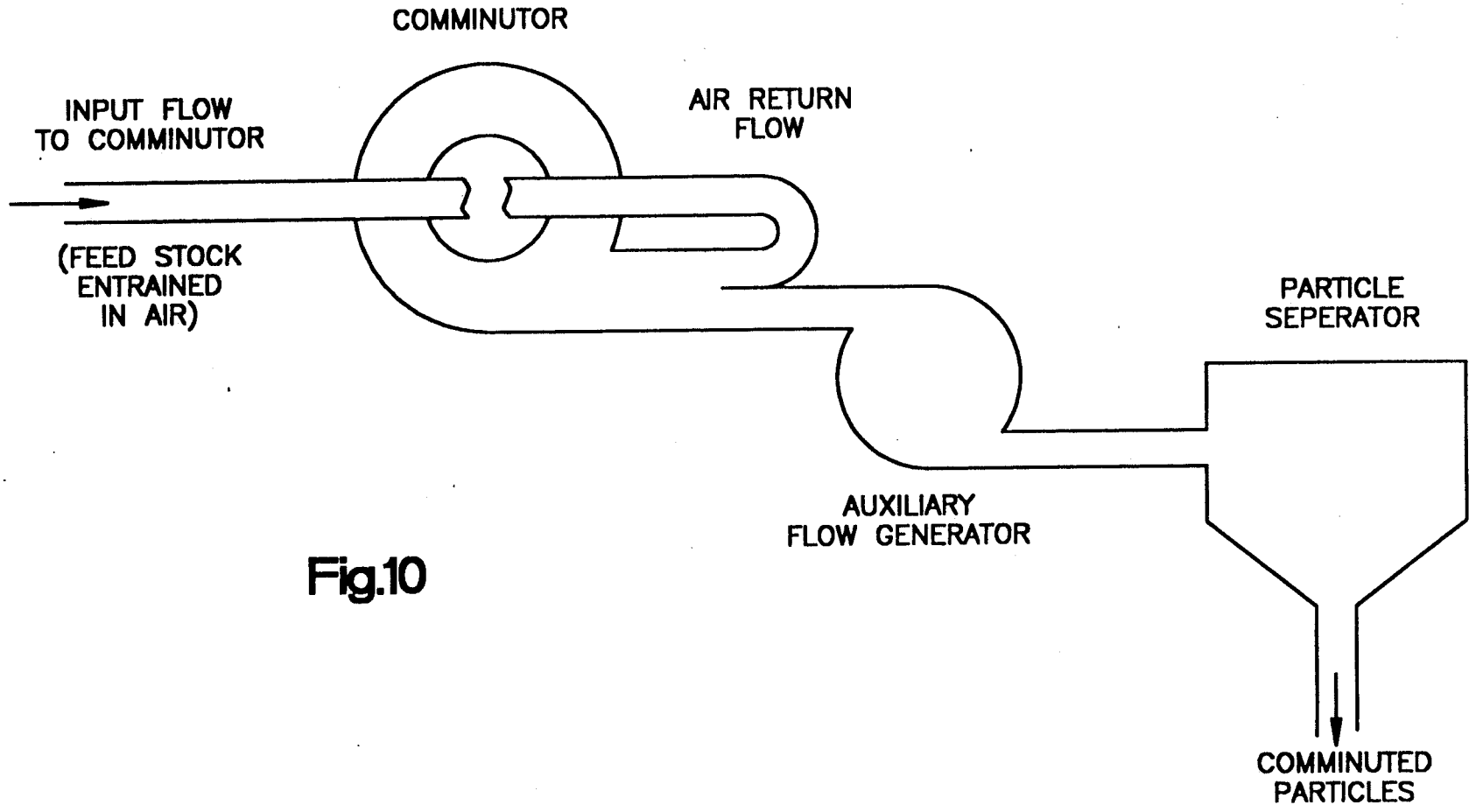
FIG. 10 is a schematic diagram illustrating the comminuting process of the invention.

The cylindrical screen assembly includes, in addition to the screens themselves, annular rib sections 46 best shown in FIGS. 7 and 8. The rib sections 46 are not permanently attached to the screen but rather function to secure them in place.

The screen sections, when in an assembled, operating condition, are interconnected in part by spring-loaded mechanisms 47 that provide some resiliency in tangential directions to accommodate dimensional variations as well as thermal expansion and contraction.

THE ROTOR ASSEMBLY

Figure 5:
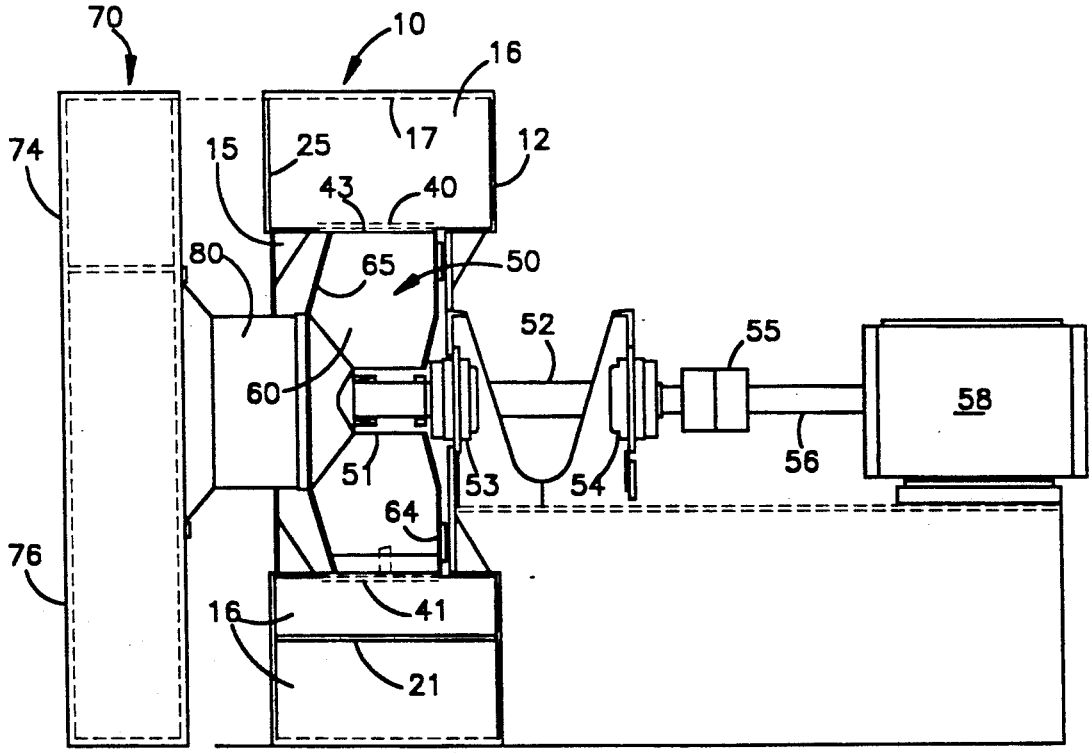
FIG. 5 is a sectional view of the apparatus of FIGS. 1, 2 and 3 taken on the line 5—5 of FIG. 2 with parts broken away for the purpose of illustration.
Figure 6:
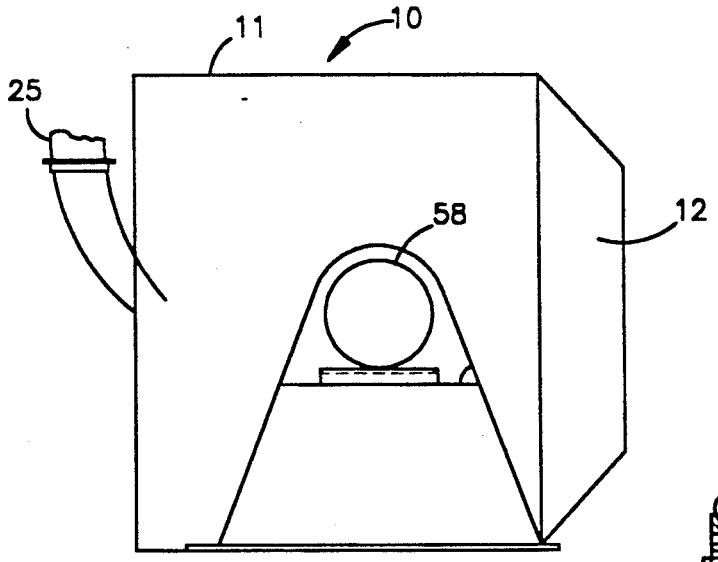
FIG. 6 is an end elevation showing the rotor drive components of the apparatus.

Referring to FIG. 5, the rotor assembly 50 includes a cylindrical hub 51 mounted on a shaft 52 that is journalled in bearing blocks 53 and 54. The shaft 52 is driven by a flexible coupling 55 which in turn is driven by the output shaft 56 of an electric drive motor 58.

The rotor assembly 50 includes a plurality of radial vanes 60 which have angled, axially outer edges so that the radially inward portions 62 and 63 of each vane enlarge as they extend radially outward up to a maximum width, whereafter each vane diminishes in width as it proceeds radially outward to its peripheral edge. An annular side wall 64 is secured on one side of the vanes from the hub out to the peripheral edges and another annular side wall 65 is secured on the opposite side of the vanes so that the outer portions of the rotor assembly define, with the respective vane sections, radial chambers 66.

Raker bars 67 are adjustably secured to the outer end portion of the radial vanes, as shown in FIGS. 7 and 8, by means of threaded fasteners 68 passing through radial sots in the raker bars 67. The raker bars 67 are provided with spaced, rectangular teeth 69, the tips thereof being carefully spaced from the inner surface of the cylindrical screen assembly 40 between minimum and maximum limits. The minimum clearance is that at which the tips are immediately adjacent to the screen assembly 40 without touching engagement. The maximum limit is determined functionally to be that at which blinding of the screen and destruction of particles do not occur. If the clearance is too great, the screen will blind over, thereby inhibiting passage of air and material therethrough. Particle or fiber destruction is observed as dust in the finished product. Typically, a clearance ob 0.065 inch is satisfactory.

The raker bars extend parallel to the axis of the rotor assembly 50 with the teeth 69 of circumferentially adjacent bars being staggered in an axial direction such that the spaces between teeth 69 of one bar are overlapped by the teeth 69 of the circumferentially adjacent bar as otherwise illustrated in FIG. 8. By this means, the entire surfaces of the screen is swept by the teeth 69 as the rotor assembly rotates.

The inner diameter of the annular side wall 65 is approximately equal to the diameter of the opening 36 so that, as will be apparent from the drawings, the flowing mixture of air with entrained feed stock enters the rotor assembly 50 in the vicinity of the radially inward portion of the vanes 60 and is then propelled radially outward in the radial chambers 66 toward the screen assembly 40.

A wiper blade 59 (FIG. 7) is mounted on the side wall 32 of the rotor housing assembly 10 and extends radially inward into the inlet opening 36. The edge of the blade is closely spaced from the edges of the radial vanes 60 so that it continuously wipes the vanes and prevents clogging of the radial chambers 66.

THE DUCT ASSEMBLY

The duct assembly 70 is formed of sheet metal panels connected together to define the various flow passages. The assembly includes a feed duct 71 for feeding material entrained in a stream of flowing air to the duct assembly 70.

The assembly further includes an air return passage defined by several interconnected duct sections to include a cross-flow section 72 connected at one end to the tangential outlet 26 of the volute-shaped passage 16, a 90° angle section 73, connected at one end of the cross-flow section 72 an upper section 74 connected at one end to the opposite end of the 90° section, a side section 75 and a lower section 76 which communicates with an inlet section that in turn communicates with the opening 36 in the side wall 34 of the rotor housing assembly 10 through which material is fed to the rotor assembly 50. The feed duct 71 has a diverter branch 82 which communicates with a trap 83, located below a grate 84 positioned in the diverter branch 82.

Located below the grate 84 is a collector bin 85 in which heavier particles, i.e., metal particles, etc. are progressively collected. The trap arrangement is necessary in order to assure that abrasive particles do not enter the rotor assembly 50. The collector bin 85 may be emptied through the use of an access door 86. The flow is directed through the diverter branch 82 by means of a trap outlet passage 87 through which the diverted flow proceeds to the feed chamber 80. The flow through the diverter branch 82 may be adjusted using the valve 88.

Figure 3:
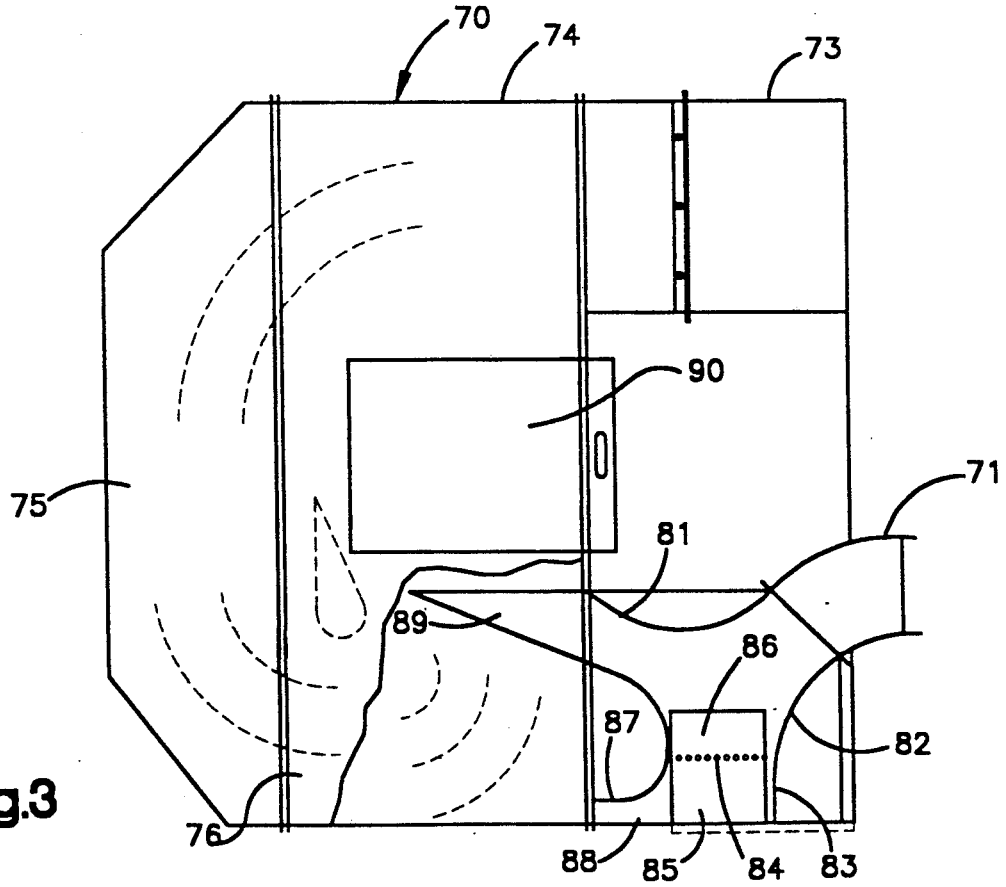
FIG. 3 is a side elevation of the apparatus of FIGS. 1 and 2 illustrating in particular the duct assembly and with parts broken away for the purpose of illustration.

The flow through the main feed branch 81 proceeds to the feed chamber through a flow guide 89, best shown in FIGS. 2 and 3. The flow guide 89 tapers toward the downstream portion and is open at the top so that the entrained material being fed is drawn into the flow produced in part by the return flow passage.

An access door 90 is located in the duct assembly 70, just opposite the feed duct, to permit access to the interior of the assembly 70.

OPERATION

In the operation of the apparatus thus described, the feed stock to be comminuted is fed in a flowing stream of air through the inlet duct 71 to the feed chamber 80 where both the return air and the new mixture are introduced into the interior of the rotor chamber 15. The rotor 50 can be operated at relatively high peripheral speeds ranging from 15,000 to 30,000 f.p.m. (feet per minute), depending on the feed stock being comminuted or fiberized, and the pressure and velocities required, and can generate internal air and material velocities through the screen, ranging from at least 1,000 to 15,000 f.p.m.

The feed stock goes through no less than three rapidly changing pressure and velocity zones thereby imparting fluid sheet forces. Further, as the air/material stream flows concurrently through the rakers at velocities up to 15,000 f.p.m. and collides with the oncoming rakers moving at 15,000 to 30,000 f.p.m., the feed stock is subjected to the dynamics of implosive forces in addition to the mechanical attrition.

When particles are of a proper size, they are forced through the sizing screen 40 at fluid pressures and velocities two to ten-fold greater than typically used in conventional hammer mill systems.

Accordingly, the combination of extremely high flow rates and continuous raking of the interior face of the screen 40 results in an extremely effective and advantageous separation of particles or fibers without causing disintegration. Also, this action produces very little dust as compared with hammer mill type processes.

After the fibers pass through the screen 40 with the air flow, they enter the volute-shaped passage 16 and proceed at high velocity around the passage in the direction of the arrows, subjecting them to considerable centrifugal force. The centrifugal force causes the entrained particles or fibers to move to the radially outward zone of the passage 16 so that the portion of the flow that is radially inward becomes essentially free of fibers.

About 60% of the flow (denoted by the symbol F1) then enters the return duct assembly 72, 73, 74, 75 and is returned to the rotor chamber 15. The remaining portion of the air flow (denoted by the symbol F2), which contains a more concentrated volume of the cellulosic fibers, exits through the outlet duct 25 and proceeds on for further processing.

As explained earlier, maintaining a proper clearance between the rakers bars 67 and the screen 40 is essential. Additionally, rotor speed, air velocity through the screen 40 and mesh size for the screen must be properly selected. It is theorized that the bulk of the combination processes is attributable to the high velocity flow of air through the screen and that the raker bars serve primarily to inhibit screen blinding and to agitate continuously the material adjacent to the screen 40. By reason of the radial chambers 66 narrowing radially outwardly, a velocity increase of the air flow correspondingly occurs in the outer peripheral portions of the rotor 60. Also, a higher pressure zone occurs adjacent to the leading surface of each vane providing for maximum pressure differential over the screen in the regions immediately adjacent to the raker bars 67. The air flow at the raker bars 67 passes not only through the screen, comminuting the material, but also between teeth 69 siding in the material agitation process. Typically, air flow through the screen 40 ranges between four and fifteen cubic feet per minute per square inch of screen. Residence time of the material within the rotor assembly 50 should be kept to a maximum, and this is assured by the high velocity air flow. Failure to maintain a sufficient high air flow permits the fed stock to be subjected to repeated attacks by the raker bars 67 which ultimately destroys the fibers and produces dust.

It is desirable to retain the physical identity of the individual particles or fibers in the finished product. Breaking or grinding the fibers is to be avoided, as this takes the form of undesired dust.

The apparatus and method of this invention produce a novel comminuted product using conventional feed stock as the raw material.

It has been found that the method and apparatus of the invention result in a reduced energy demand for the production of particles. The energy reduction, for example, has been found in specific applications to be between 30% and 40% less than that required in a hammer mill type system.

As explained previously, it is theorized that the fiberizing action is derived primarily from the air flow through the screen 40. While the preferred form of the apparatus is as discloses herein, it is possible to generate the air flow requirements externally rather than internally. Use of high pressure air source, external of the screen/raker combination along with suitable ducting is considered to be including within the broadest scope of this invention. In this alternative form, it is not necessary to use vanes, but it is important that raker bars and the co-action thereof with the sizing screen be preserved.

While the invention has been shown and described with respect to a specific embodiment thereof, this is intended for the purpose of illustration rather than limitation and other variations and modifications of the specific method and apparatus herein shown and described will be apparent to those skilled inn the art, all within the intended spirit and scope of the invention. Accordingly, the invention is not to be limited in scope and effect to the specific embodiments herein shown and described, nor in any other way that is inconsistent with the extent to which the progress in the art has been advanced by the invention.

What is claimed is:

1. Apparatus for comminuting feed stock to form a low density fibrous product comprising:

a housing defining:

a cylindrical rotor chamber, a passage formed around said rotor chamber, an outlet from said passage, and, axial inlet means for feeding said feed stock into the central portion of said rotor chamber;

means for delivering said feed stock to said axial inlet means entrained in a flowing fluid stream;

a perforate cylindrical screen mounted in said housing about said axis between said rotor chamber and said passage;

a centrifugal blower mounted in said rotor chamber for rotation about said axis and having a plurality of radial vanes with rakers mounted at the outer ends thereof, said rakers being closely spaced from the inner surface of said screen to prevent clogging of the openings in said screen;

drive means for said rotor; and grate means disposed generally parallel to the path of said fluid flowing stream prior to said central portion of said rotor chamber for separating undesirably heavy components of said feed stock therefrom prior to said feed stock being delivered to said axial inlet means.

2. Apparatus as defined in claim 1, further including a fixed wiper means located in said axial inlet means and having a longitudinal edge portion positioned closely adjacent the radially inward side edges of said radial vanes to prevent clogging of said axial inlet means.

3. Apparatus as defined in claim 2, wherein said longitudinal edge portion extends in a generally radially inward direction.

4. Apparatus as defined in claim 1, further including auxiliary flow generator means for producing in cooperation with said rotor, a fluid stream velocity of at least 1,000 feet per minute through the perforations in said screen.

5. Apparatus as defined in claim 4, wherein said auxiliary flow generated means is located downstream of said outlet.

6. Apparatus as defined in claim 4, wherein said fluid stream velocity produced is between at least 1,000 and 15,000 feet per minute.

7. Apparatus as defined in claim 1, wherein said passage formed around said rotor is volute-shaped and wherein said outlet is tangential and located at the downstream end of said volute-shaped passage.

8. Apparatus as defined in claim 7, further including air return means communicating between a radially inward portion of said tangential outlet and said axial inlet means.

9. Apparatus as defined in claim 8, wherein said air return duct is of sufficient size to return about 60 percent of the air flow volume from said tangential outlet to said axial inlet.

10. Apparatus as defined in claim 1, wherein said means for separating undesirable objects from said feed stock comprises a flow diverter for diverting a lower portion of the flowing fluid stream in said delivering means, from said fluid stream and trap means adapted to receive said diverted lower portion of said fluid stream whereby relatively heavy components of said feed stock are separated by gravity and accumulated in a collector bin in said trap means.

11. Apparatus for comminuting feed stock to form a low density fibrous product comprising:

a housing defining:

a cylindrical rotor chamber, a passage formed around said rotor chamber, an outlet from said passage, and axial inlet means for feeding said feed stock into the central portion of said rotor chamber;

means for delivering said feed stock to said axial inlet means entrained in a fluid stream;

a perforate screen mounted in said housing about said axis between said rotor chamber and said volute-shaped passage;

a rotor mounted in said rotor chamber for rotation about said axis and having a plurality of radial vanes with rakers mounted at the outer ends thereof, said rakers being closely spaced from the inner surface of said screen to prevent clogging of the openings in said screen;

drive means for said rotor;

means including said rotor for generating a fluid stream velocity of at least 1,000 feet per minute through the perforations in said screen and means disposed generally parallel to said fluid stream and associated with said feed stock delivery means for separating undesirable, relatively heavy components from said feed stock prior to delivery of said feed stock to said axial inlet means.

12. Apparatus as defined in claim 11, wherein said means for generating a fluid stream velocity further includes an auxiliary flow generator.

13. Apparatus as defined in claim 12, wherein said auxiliary flow generator is located downstream of said outlet.

14. Apparatus as defined in claim 11, wherein said fluid stream velocity produced through said perforations is between at least 1,000 and 15,000 feet per minute.

15. Apparatus as defined in claim 11, wherein said passage formed around said rotor is volute-shaped and wherein said outlet is tangential and located at the downstream end of said volute-shaped passage.

16. Apparatus as defined in claim 15, further including air return means communicating between a radially inward portion of said tangential outlet and said axial inlet means.

17. A method for comminuting feed stock to form a low density, product comprising:

feeding said feed stock entrained in a fluid stream to a central portion of a cylindrical rotor chamber;

separating undesirably heavy components of said fed stock via grate means disposed generally parallel to the path of said fluid stream prior to said components reaching a centrifugal rotor having radial vanes;

driving said centrifugal rotor at relatively high speed in said chamber to generate a high velocity air flow with said feed stock entrained therein to force said organic material radially outward in said rotor chamber at relatively high velocity;

forcing said resulting fluid flow radially outward through perforations in a cylindrical screen surrounding said rotor at a fluid stream velocity of at least 1,000 feet per minute through the perforations in said screen to comminute said feed stock; and discharging the comminuted product.

18. A method as defined in claim 17, wherein the high velocity fluid flow is produced in part by auxiliary flow generating means separate from said centrifugal rotor.

19. A method as defined in claim 17, wherein said auxiliary flow generating means is located downstream of the location where the comminuted product is discharged.

20. A method as defined in claim 17, including the additional step of diverting a lower portion of the flowing fluid stream before it is fed to the cylindrical rotor chamber to a trap means wherein relatively heavy components of said feed stock are separated by gravity and accumulated in a collector.

21. A method as defined in claim 17, including the additional step of centrifugally separating the comminuted product from a portion of the air volume flowing through said screen.

22. A comminuted product made in accordance with the method of claim 17.

23. A comminuted product as defined in claim 21, having a settled density of between about 0.7 and about 1.9 pounds per cubic foot.

24. A comminuted product as defined in claim 21, having a settled density of between about 1.3 and about 1.6 pounds per cubic foot.

25. A comminuted product as defined in claim 21, having an R value of about 3.8.

26. A comminuted product as defined in claim 22, wherein course pieces constitute less than 4 percent of the total volume.

* * * * *